US009677382B2

(12) United States Patent
Mageren

(10) Patent No.: US 9,677,382 B2
(45) Date of Patent: Jun. 13, 2017

(54) HYDRAULIC CONTROL OF DOWNHOLE TOOLS

(71) Applicant: Halliburton Energy Services, Inc., Houston, TX (US)

(72) Inventor: Olivier Mageren, Jette (BE)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/417,713

(22) PCT Filed: Dec. 6, 2013

(86) PCT No.: PCT/US2013/073623

§ 371 (c)(1),
(2) Date: Jan. 27, 2015

(87) PCT Pub. No.: WO2015/084400

PCT Pub. Date: Jun. 11, 2015

(65) Prior Publication Data

US 2016/0273311 A1 Sep. 22, 2016

(51) Int. Cl.
*E21B 41/00* (2006.01)
*E21B 23/00* (2006.01)
(Continued)

(52) U.S. Cl.
CPC ..... *E21B 41/00* (2013.01); *E21B 21/08* (2013.01); *E21B 23/004* (2013.01); *E21B 23/04* (2013.01);
(Continued)

(58) Field of Classification Search
CPC ..... E21B 29/005; E21B 10/322; E21B 10/32
See application file for complete search history.

(56) References Cited

U.S. PATENT DOCUMENTS 5,103,902 A 4/1992 Ross et al.
6,513,589 B1 2/2003 Hansen et al.
(Continued)

FOREIGN PATENT DOCUMENTS

CN 101096904 1/2008
CN 104271868 1/2015
(Continued)

OTHER PUBLICATIONS

"International Application Serial No. PCT/US2013/073623, International Search Report mailed Sep. 2, 2014", 3 pgs.
(Continued)

*Primary Examiner* — Blake Michener
*Assistant Examiner* — Manuel C Portocarrero
(74) *Attorney, Agent, or Firm* — Chamberlain Hrdlicka

(57) ABSTRACT

A tool control mechanism is configured to activate and deactivate a drill string tool by hydraulic action of drilling fluid. The tool control mechanism is switchable between an activation mode and a deactivation mode. In the activation mode, a hydraulic activator ram is coupled to a tool switch member to drive the switch member in an activation direction in response to above-threshold drilling fluid conditions. In the deactivation mode, a deactivator ram is coupled to the tool switch member to drive the switch member in a deactivation direction opposite to the activation direction, when above-threshold drilling fluid conditions occur. The tool control mechanism is switchable between the activation mode and the deactivation mode by operator-controlled drilling fluid pressure variations.

21 Claims, 9 Drawing Sheets

Fig. 3

(51) Int. Cl.

| | |
|---|---|
| ***E21B 23/04*** | (2006.01) |
| ***E21B 3/02*** | (2006.01) |
| ***E21B 4/02*** | (2006.01) |
| ***E21B 7/28*** | (2006.01) |
| ***E21B 10/32*** | (2006.01) |
| ***E21B 21/08*** | (2006.01) |
| ***E21B 44/00*** | (2006.01) |
| ***E21B 47/12*** | (2012.01) |

(52) U.S. Cl.
CPC . *E21B 3/02* (2013.01); *E21B 4/02* (2013.01); *E21B 7/28* (2013.01); *E21B 10/322* (2013.01); *E21B 44/00* (2013.01); *E21B 47/12* (2013.01)

(56) References Cited

U.S. PATENT DOCUMENTS 6,595,296 B1 7/2003 French
8,104,549 B2 * 1/2012 Lee ..... E21B 10/32 175/267
8,739,890 B2 6/2014 Noffke
2003/0217850 A1 * 11/2003 Shaw ..... E21B 10/322 166/374
2004/0060710 A1 * 4/2004 Marshall ..... E21B 10/322 166/381
2010/0282474 A1 11/2010 Mohr
2013/0175095 A1 * 7/2013 Dewey ..... E21B 21/103 175/269
2013/0233570 A1 * 9/2013 Acosta ..... E21B 23/06 166/383
2015/0292281 A1 * 10/2015 Hardin, Jr. ..... E21B 21/08 166/374

FOREIGN PATENT DOCUMENTS

WO WO-2013165412 A1 11/2013
WO WO-2015/084400 A1 6/2015

OTHER PUBLICATIONS

"International Application Serial No. PCT/US2013/073623, Written Opinion mailed Sep. 2, 2014", 5 pgs.

* cited by examiner

HYDRAULIC CONTROL OF DOWNHOLE TOOLS

PRIORITY APPLICATIONS

This application is a U.S. National Stage Filing under 35 U.S.C. 371 from International Application No. PCT/US2013/073623, filed on 6 Dec. 2013; which application is incorporated herein by reference in their entirety.

TECHNICAL FIELD

The present application relates generally to downhole tools in drilling operations, and to methods of operating downhole tools. Some embodiments relate more particularly to drilling fluid-activated control systems, apparatuses, mechanisms and methods for controlling operation of downhole tools. The disclosure also relates to downhole reamer deployment control by controlling downhole pressure conditions of drilling fluid, e.g., drilling mud, conveyed by a drill string.

BACKGROUND

Boreholes for hydrocarbon (oil and gas) production, as well as for other purposes, are usually drilled with a drill string that includes a tubular member (also referred to as a drill pipe) having a drilling assembly which includes a drill bit attached to the bottom end thereof. The drill bit is rotated to shear or disintegrate material of the rock formation to drill the wellbore. The drill string often includes tools or other devices that are in operation located downhole and therefore require remote activation and deactivation during drilling operations. Such tools and devices include, for example, reamers, stabilizers or force application members used for steering the drill bit.

Electro-mechanical control systems, for example, are often unreliable in such drilling environments. Remote control of downhole tool activation by agency of fluid pressure in the drill string often allows only a limited number of activation/deactivation cycles, after which the control system is to be reset, while reduction in effective drill string diameter result in some systems. Some reamer activation apparatuses, for example, make use of a ball-drop mechanism that permits a single activation cycle, after which a reset of the control system is required.

Using the drilling fluid (e.g., mud cycled down the drill string and back up a borehole annulus) as a deployment mechanism can introduce a risk of inadvertent tool activation or deactivation.

BRIEF DESCRIPTION OF THE DRAWINGS

Some embodiments are illustrated by way of example and not limitation in the figures of the accompanying drawings in which:

FIG. 4A and FIG. 4B are side views of the controller assembly for a downhole tool, in accordance with an example embodiment, a housing of the controller assembly being omitted in FIG. 4A for illustrative purposes, while FIG. 4B shows the controller assembly, including its housing, in sectional side view.

DETAILED DESCRIPTION

The following detailed description describes example embodiments of the disclosure with reference to the accompanying drawings, which depict various details of examples that show how the disclosure may be practiced. The discussion addresses various examples of novel methods, systems and apparatuses in reference to these drawings, and describes the depicted embodiments in sufficient detail to enable those skilled in the art to practice the disclosed subject matter. Many embodiments other than the illustrative examples discussed herein may be used to practice these techniques. Structural and operational changes in addition to the alternatives specifically discussed herein may be made without departing from the scope of this disclosure.

In this description, references to "one embodiment" or "an embodiment," or to "one example" or "an example" in this description are not intended necessarily to refer to the same embodiment or example; however, neither are such embodiments mutually exclusive, unless so stated or as will be readily apparent to those of ordinary skill in the art having the benefit of this disclosure. Thus, a variety of combinations and/or integrations of the embodiments and examples described herein may be included, as well as further embodiments and examples as defined within the scope of all claims based on this disclosure, as well as all legal equivalents of such claims.

One aspect of the disclosure describes a downhole tool control mechanism configured to activate a downhole tool by hydraulic action of a drilling fluid, and to deactivate the downhole tool by hydraulic action of the drilling fluid, the control mechanism being switchable by operator control of drilling fluid conditions between an activation mode and a deactivation mode.

Such hydraulically driven deactivation provides a repeatable cycle of activation and deactivation, with a deactivation mechanism that display superior reliability and controllability than existing deactivation mechanisms in which tool deactivation as through the agency of a bias mechanism such as, for example, a compression spring.

The control mechanism may be a passive mechanical system, being configured such that functional operation of the control mechanism responsive to pressure difference variations is substantially exclusively mechanical, comprising, e.g., one or more hydraulic actuating mechanisms, spring biasing mechanisms, and cam mechanisms). In such a case, at least those parts of the control mechanism that provide the disclosed functionalities may operate without contribution from any substantially non-mechanical components (e.g., electrical components, electromechanical components, or electronic components).

Figure 1:
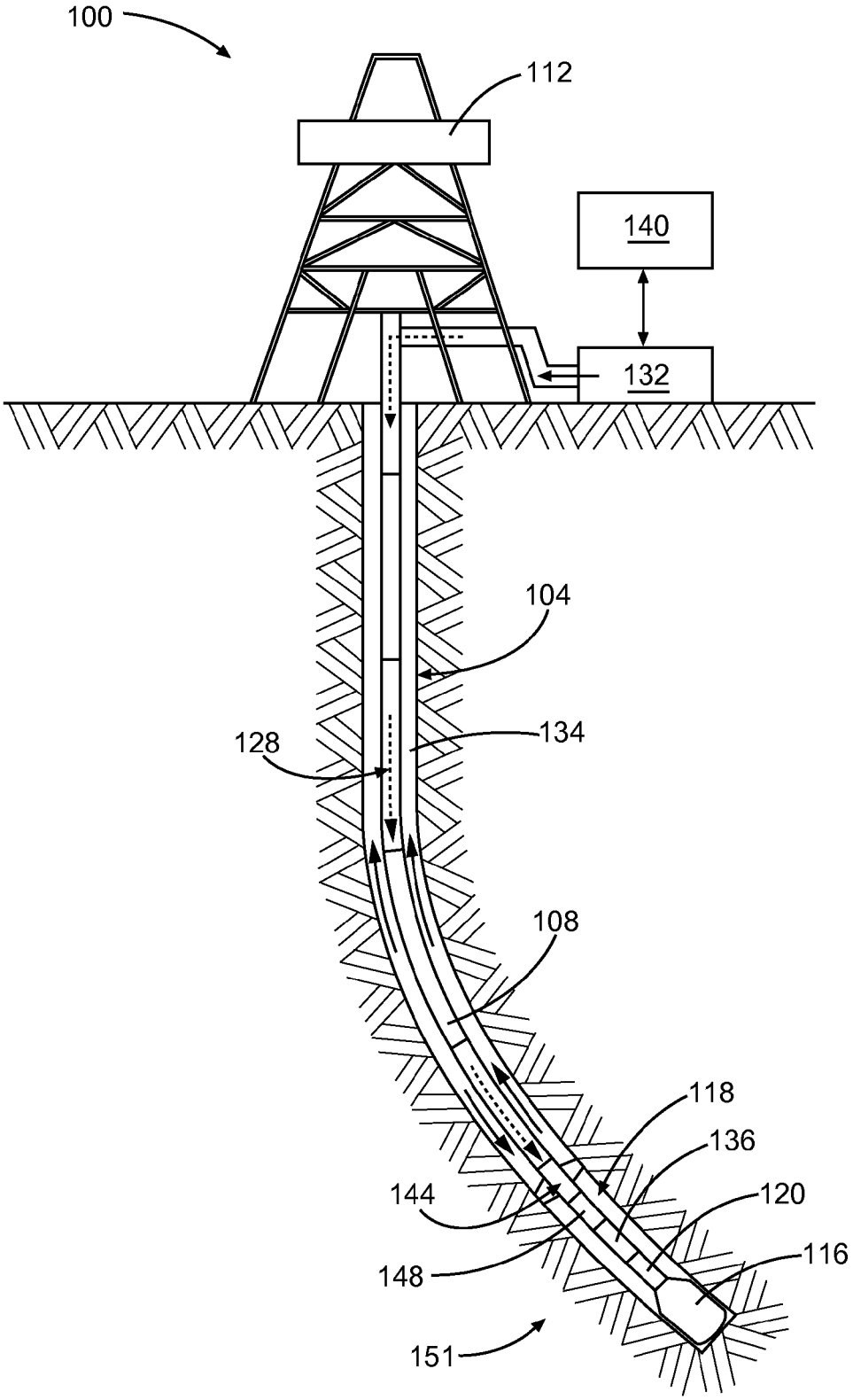
FIG. 1 depicts a schematic elevational diagram of a drilling installation including a drill tool assembly comprising a downhole tool and a drilling fluid-operable control mechanism for selective hydraulically actuated tool activation and hydraulically actuated tool deactivation, in accordance with an example embodiment.

FIG. 1 is a schematic view of an example embodiment of a system to control hydraulically actuated activation and hydraulically actuated deactivation of a downhole tool by operator control of pressure conditions of a drilling fluid (e.g., drilling mud).

A drilling installation 100 includes a subterranean borehole 104 in which a drill string 108 is located. The drill string 108 may comprise jointed sections of drill pipe suspended from a drilling platform 112 secured at a wellhead. A downhole assembly or bottom hole assembly (BHA) 151 at a bottom end of the drill string 108 may include a drill bit 116 to disintegrate earth formations, piloting the borehole 104, and may further include one or more reamer assemblies 118, uphole of the drill bit 116 to widen the borehole 104 by operation of selectively deployable cutting elements. A measurement and control assembly 120 may be included in the BHA 151, which also includes measurement instruments to measure borehole parameters, drilling performance, and the like.

The borehole 104 is thus an elongated cavity that is substantially cylindrical, having a substantially circular cross-sectional outline that remains more or less constant along the length of the borehole 104. The borehole 104 may in some cases be rectilinear, but may often include one or more curves, bends, doglegs, or angles along its length. As used with reference to the borehole 104 and components therein, the "axis" of the borehole 104 (and therefore of the drill string 108 or part thereof) means the longitudinally extending centerline of the cylindrical borehole 104 (corresponding, for example, to longitudinal axis 348 in FIG. 3).

"Axial" and "longitudinal" thus means a direction along a line substantially parallel with the lengthwise direction of the borehole 104 at the relevant point or portion of the borehole 104 under discussion; "radial" means a direction substantially along a line that intersects the borehole axis and lies in a plane perpendicular to the borehole axis; "tangential" means a direction substantially along a line that does not intersect the borehole axis and that lies in a plane perpendicular to the borehole axis; and "circumferential" or "rotational" means a substantially arcuate or circular path described by rotation of a tangential vector about the borehole axis. "Rotation" and its derivatives mean not only continuous or repeated rotation through 360° or more, but also includes angular or circumferential displacement of less than 360°.

As used herein, movement or location "forwards" or "downhole" (and related terms) means axial movement or relative axial location towards the drill bit 116, away from the surface. Conversely, "backwards," "rearwards," or "uphole" means movement or relative location axially along the borehole 104, away from the drill bit 116 and towards the earth's surface. Note that in FIGS. 2, 3, 4, 6, and 7 of the drawings, the downhole direction of the drill string 108 extends from left to right.

Drilling fluid (e.g. drilling "mud," or other fluids that may be in the well), is circulated from a drilling fluid reservoir, for example a storage pit, at the earth's surface (and coupled to the wellhead) by a pump system 100 that forces the drilling fluid down a drilling bore 128 provided by a hollow interior of the drill string 108, so that the drilling fluid exits under relatively high pressure through the drill bit 116. After exiting from the drill string 108, the drilling fluid moves back upwards along the borehole 104, occupying a borehole annulus 134 defined between the drill string 108 and a wall of the borehole 104. Although many other annular spaces may be associated with the system 102, references to annular pressure, annular clearance, and the like, refer to features of the borehole annulus 134, unless otherwise specified or unless the context clearly indicates otherwise.

Note that the drilling fluid is pumped along the inner diameter (i.e., the bore 128) of the drill string 108, with fluid flow out of the bore 128 being restricted at the drill bit 116. The drilling fluid then flows upwards along the annulus 134, carrying cuttings from the bottom of the borehole 104 to the wellhead, where the cuttings are removed and the drilling fluid may be returned to the drilling fluid reservoir 132. Fluid pressure in the bore 128 is therefore greater than fluid pressure in the annulus 134. Tool activation through control of drilling fluid conditions may thus comprise controlling a pressure differential between the bore 128 and the annulus 134, although downhole drilling fluid conditions may, in other embodiments, be referenced to isolated pressure values in the bore 128. Unless the context indicates otherwise, the term "pressure differential" means the difference between general fluid pressure in the bore 128 and pressure in the annulus 134.

In some instances, the drill bit 116 is rotated by rotation of the drill string 108 from the platform 112. In this example embodiment, a downhole motor 136 (such as, for example, a so-called mud motor or turbine motor) disposed in the drill string 108 and, this instance, forming part of the BHA 151, may contribute to rotation of the drill bit 116. In some embodiments, the rotation of the drill string 108 may be selectively powered by surface equipment, by the downhole motor 136, or by both the surface equipment and the downhole motor 136.

The system 100 may include a surface control system 140 to receive signals from downhole sensors and telemetry equipment, the sensors and telemetry equipment being incorporated in the drill string 108, e.g., forming part of the measurement and control assembly 120. The surface control system 140 may display drilling parameters and other information on a display or monitor that is used by an operator to control the drilling operations. Some drilling installations may be partly or fully automated, so that drilling control operations (e.g., control of operating parameters of the motor 136 and control of downhole tool deployment through control of downhole drilling fluid pressure conditions, as described herein) may be either manual, semi-automatic, or fully automated. The surface control system 140 may comprise a computer system having one or more data processors and data memories. The surface control system 140 may process data relating to the drilling operations, data from sensors and devices at the surface, data received from downhole, and may control one or more operations of downhole tools and/or surface devices.

The drill string 108 may include one or more downhole tools instead of or in addition the reamer assembly 118. The downhole tools of the drill string 108, in this example, thus includes at least one reamer assembly 118 located in the BHA 151 to enlarge the diameter of the borehole 104 as the BHA 151 penetrates the formation. In other embodiments, the drill string 108 may comprise multiple reamer assemblies 118, for example being located adjacent opposite ends of the BHA 151 and being coupled to the BHA 151.

Figure 2:
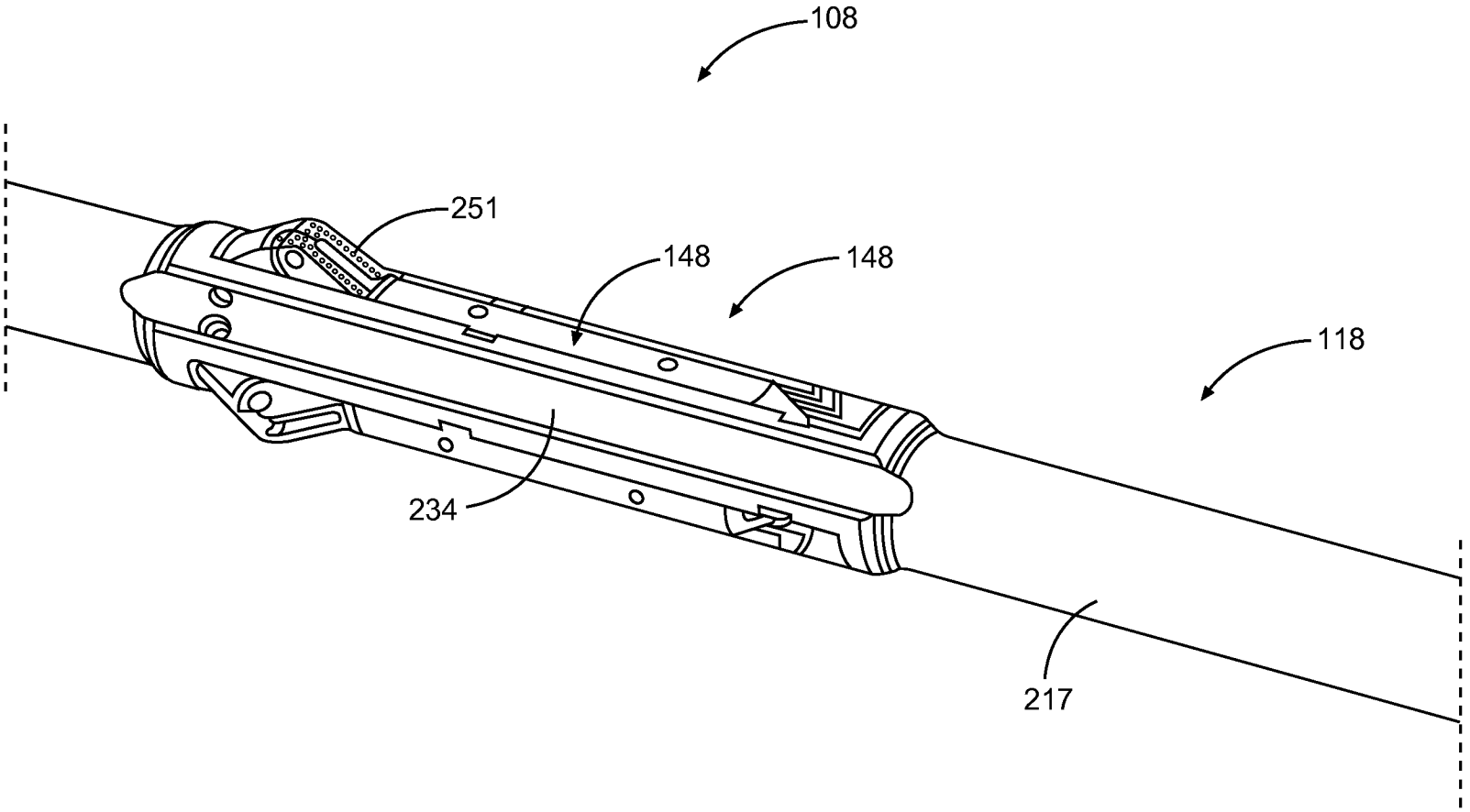
FIG. 2 depicts a three-dimensional view of a reamer assembly comprising a reamer and a controller configured for selective hydraulically actuated tool activation and deactivation, in accordance with an example embodiment.

Each reamer assembly 118 may comprise one or more circumferentially spaced blades or other cutting elements that carry cutting structures (see, e.g., reamer arms 251 in FIG. 2). The reamer assembly 118 includes a reamer 144 comprising a generally tubular reamer housing 234 connected in-line in the drill string 108 and carrying the reamer arms 251, which are radially extendable and retractable from a radially outer surface of the reamer housing 234, to selectively expand and contract the reamer's effective diameter.

Controlled selection of an operational condition of the reamer 144 (e.g., an activated condition in which the reamer arms 251 are deployed, and a deactivated condition in which the reamer arms 251 are retracted) may be effected by controlling drilling fluid pressure. In this example the reamer assembly 118 includes a subassembly in the example form of a controller 148 that provides deployment control mechanisms configured to permit selective hydraulically actuated deployment and retraction of the reamer cutter arms 251 responsive to provision of particular predefined downhole drilling fluid conditions. The controller 148 may comprise an apparatus having a drill-pipe body or housing 217 (see FIG. 2) connected in-line in the drill string 108. In the example embodiment of FIG. 1, the controller 148 is mounted downhole of the tool reamer 144, but in other embodiments (e.g. the example embodiment illustrated in FIG. 4), the controller 148 may be positioned uphole of the reamer 144.

Although fluid-pressure control of tool deployment (example mechanisms of which will be discussed presently) provides a number of benefits compared, e.g., to electromechanical deployment mechanisms, such fluid-pressure control may introduce difficulties in performing drilling operations. There is seldom, for example, a simple direct correspondence between fluid pressure values and desired reamer deployment. Although reaming operations in this example coincide with high fluid pressure in the bore 128 (also referred to as bore pressure or internal pressure), the reamer 144 is not to be deployed with every occurrence of high bore pressure. The bore pressure may, for example be ramped up to drive the drill bit 116 via the motor 136 when the borehole 104 is being drilled.

The example controller 148 ameliorates this difficulty by provision of a deployment control mechanism that is switchable between an activation mode (in which the reamer arms 251 are automatically deployed when the bore-annulus pressure differential is raised to reaming levels, also referred to herein as an operational level) and a deactivation mode (in which the reamer arms 251 are retracted and remain retracted when the pressure differential is raised to reaming levels). As will be described below, mode switching can in this example embodiment be achieved only by raising the drilling fluid pressure differential to predetermined mode switching levels, which are higher than the operational levels at which reaming is typically performed.

FIG. 2 shows an example embodiment of a reamer assembly 118 that may form part of the drill string 108, with the reamer 144 that forms part of the reamer assembly 118 being in an activated condition. In this activated or deployed mode, reamer cutting elements in the example form of reamer arms 251 are radially extended, standing proud of the reamer housing 234 and projecting radially outwards from the reamer housing 234 to make contact with the borehole wall for reaming of the borehole 104 when the reamer housing 234 rotates with the drill string 108.

In this example, the reamer arms 251 are mounted on the reamer housing 234 in axially aligned, hingedly connected pairs that jackknife into deployment, when activated. When, in contrast, the reamer 144 is in the deactivated condition, the reamer arms 251 are retracted into the tubular reamer housing 234. In the retracted mode, the reamer arms 251 do not project beyond the radially outer surface of the reamer housing 234, therefore clearing the annulus 134 and allowing axial and rotational displacement of the reamer housing 234 as part of the drill string 108, without engagement of a borehole wall by the reamer arms 251.

Figure 3:
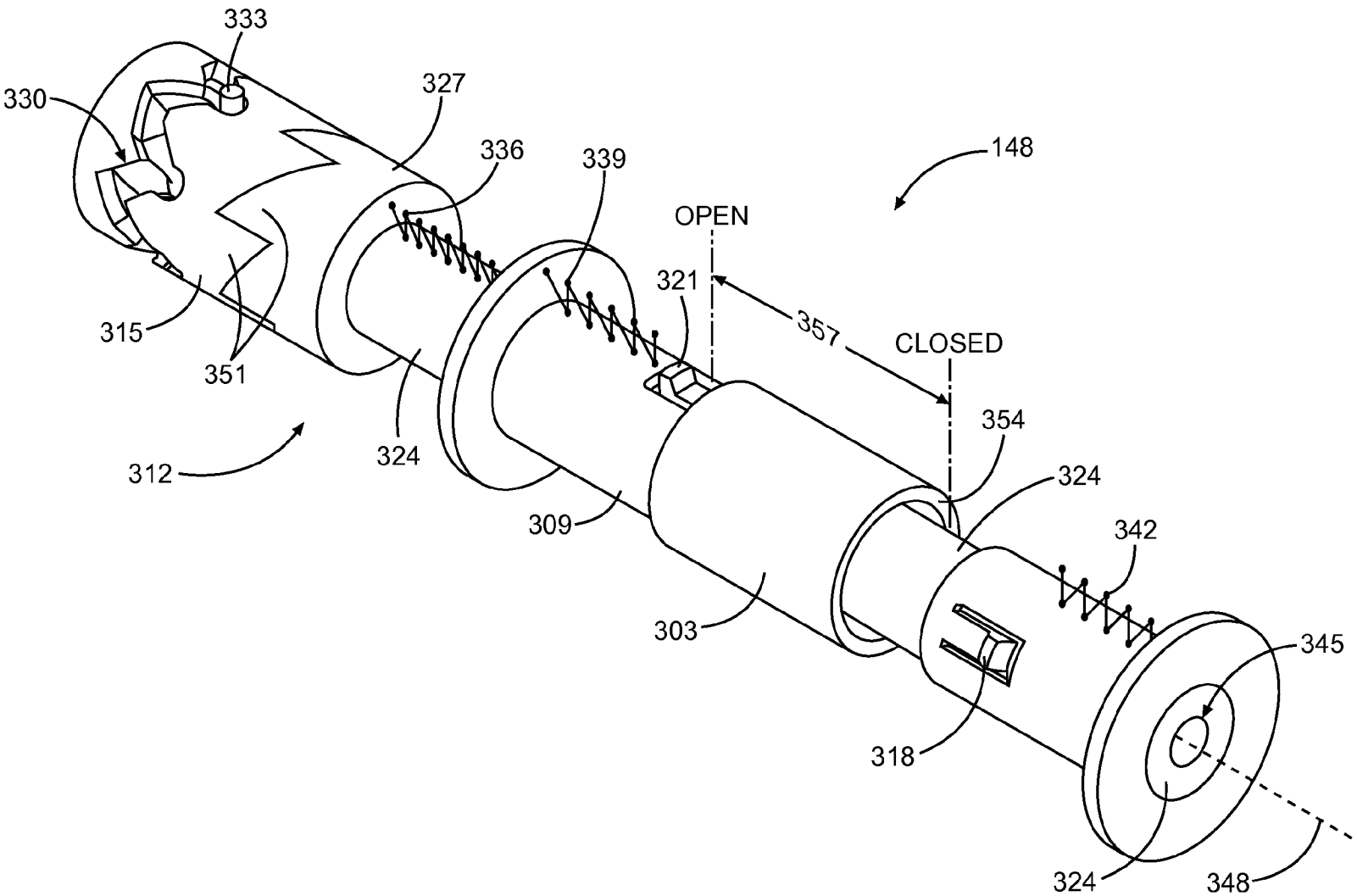
FIG. 3 is a partial, schematic three-dimensional view of a controller assembly for a downhole tool, in accordance with an example embodiment, a housing of the controller assembly being omitted in FIG. 3, to expose internal components of the example controller assembly for illustrative purposes.
Figure 4A:
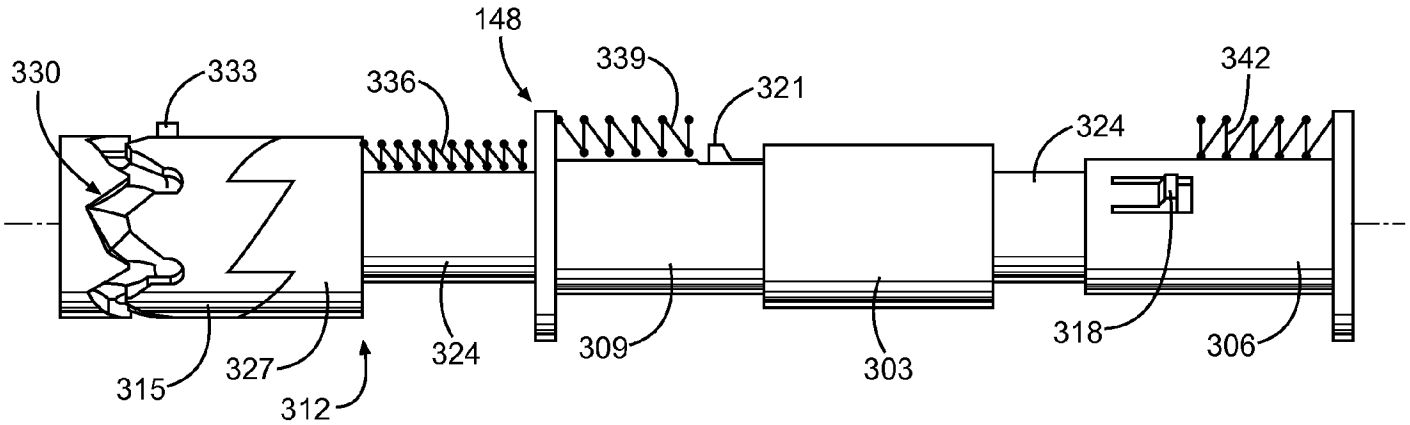
Figure 4B:
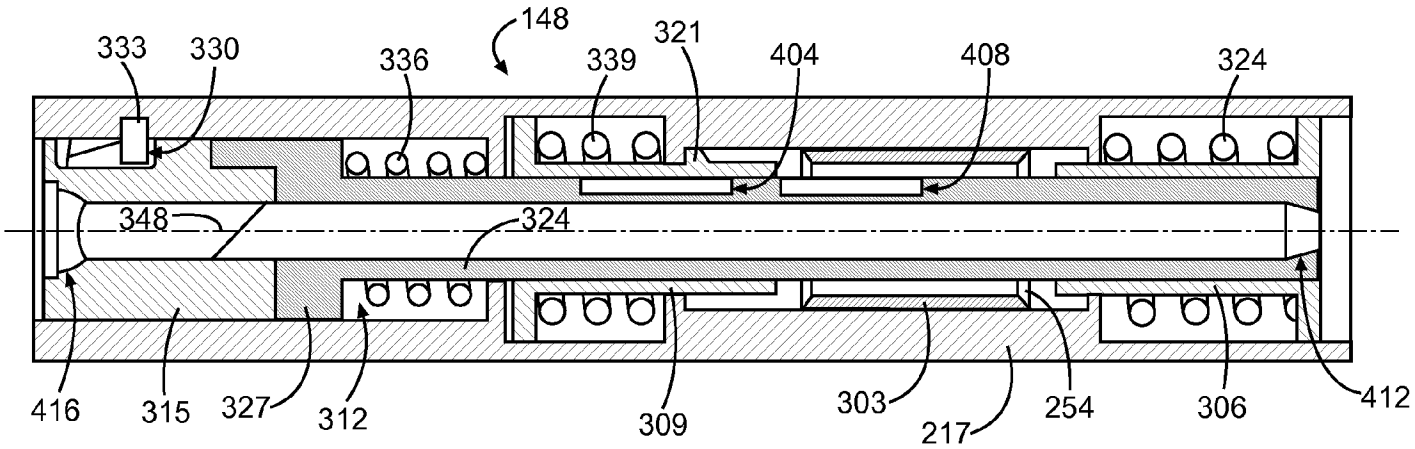

FIGS. 3 and 4 schematically illustrate an example embodiment of a controller 148 to form part of the drill string 108, being operatively connected to the reamer 144 in the reamer assembly 118. The controller 148 has a generally tubular housing 217 (FIG. 4B) that may comprise co-axially connected drill pipe sections which are connected in-line with and form part of the tubular body of the drill string 108. The drill pipe sections may be connected together by screw-threaded engagement of complementary connection formations at adjacent ends of the respective drill pipe sections, to form a screw threaded joint. The housing 217 is thus incorporated in the drill string, to transfer torque and rotation from one end of the housing 217 to the other. The housing 217 is not shown in FIG. 3, and in some of the other views of the controller 148 in the drawing figures, to expose internal components of the controller 148 more clearly for the purposes of description.

The controller 148 comprises a switch member in the example form of a switch sleeve 303 which is co-axially mounted in the housing 217 and is configured for hydraulically driven reciprocating axial displacement in the housing 217 within a switching zone 357. The switch sleeve 303 is connected to the reamer 144 by a mechanical linkage, to switch the reamer 144 between the activated condition and the deactivated condition by shuttling of the switch sleeve 303 from one end of the switching zone 357 to the other. In this example, an uphole end of the switching zone 357 (i.e., the leftmost end of the switching zone 357 in FIG. 6) corresponds to the activated condition of the reamer 144, in which the reamer arms 251 are radially extended for reaming, while a downhole end of the switching zone 357 (i.e., the rightmost end of the switching zone 357 in FIG. 3) corresponds to the deactivated condition of the reamer 144, in which the reamer arms 251 are a radially retracted). The uphole axial direction (i.e., leftward in FIG. 3) therefore, in this example embodiment, comprises an activating direction in which the switch sleeve 303 is to be actuated in order to deploy the reamer arms 251, while the downhole axial direction (i.e., rightward in FIG. 3) comprises a deactivating direction in which the switch sleeve 303 is to be displaced to switch the reamer 144 from the activated condition to the deactivated condition.

The controller 148 further comprises a hydraulic actuation mechanism to drive the switch sleeve 303 by positive hydraulic actuation both in the activation direction and in the deactivating direction. In this example embodiment, the hydraulic actuation mechanism comprises a pair of hydraulic rams mounted in the housing 217 and configured for synchronous, oppositely directed movement in the activating direction and in the deactivating direction respectively. The hydraulic rams comprise an activator ram in the example form of an activator piston 306 (FIG. 3), and a deactivator ram in the example form of a deactivator piston 309.

As shown in FIG. 3, the pistons 306, 309 are co-axially aligned and are spaced apart along a longitudinal axis 348 of the housing 217, being located to opposite ends of the switch sleeve 303, adjacent opposite ends of the switching zone 357. The pistons 306, 309 therefore longitudinally flank the switch sleeve 303, with the switch sleeve 303 being located between them. The pistons 306, 309 are configured for synchronous axial displacement towards each other in response to predetermined above-threshold drilling fluid conditions, which in this example embodiment comprises a bore-annulus pressure differential which is above a predefined threshold and falls within an operational pressure differential range at which reaming of the borehole 104 is to be performed by the reamer 144. The activator piston 306 is configured for hydraulic actuation in the in the activating direction (e.g., uphole in this example embodiment), to shunt the switch sleeve 303 from a deactivated position at the downhole end of the switching zone 357, to an activated position at the uphole end of the switching zone 357. The deactivator piston 309 is oppositely disposed, being configured for hydraulic actuation in the deactivating direction (e.g., downhole in this example embodiment).

In this description, unless otherwise stated, hydraulic actuation of the various components of the controller 148 and the reamer 144 comprises displacement of a prime mover for the relevant operation under the urging of hydraulic forces originating with pressurization of the drilling fluid (e.g., drilling mud). The activator piston 306 and the deactivator piston 309 may each, for example comprise a tubular body 505 (see, for example, FIG. 5) from which an annular rim or flange 510 project radially outwards for exposure to the bore-annulus pressure differential across it in corresponding drilling fluid volumes provided, for example, by the housing 217. The flange of the activator piston 306 may thus, for example, be located in the housing 217 such that an axial end face of the flange 510 on the downhole side is exposed to drilling mud at bore pressure, while the other end face of the flange 510 on the downhole side may be exposed to drilling mud at a relatively lower annulus pressure. Configuration and arrangement of the deactivator piston 309 for operative, hydraulically actuated displacement thereof in the deactivating direction (e.g., the downhole direction) may be similar or analogous to that described with reference to the activator piston 306, except that the deactivator piston 309 is oppositely disposed, so that the differential pressure acting across its flange 510 urges the deactivator piston 309 downhole, in the deactivating direction.

The pistons 306, 309 each has an axial bias mechanism to urge the pistons 306, 309 away from each other, and away from the switching zone 357. In this example, the bias mechanism of the activator piston 306 comprises an activator spring 342 in the example form of a helical compression spring co-axial with the tubular body 505 of the activator piston 306, and positioned to provide resiliently elastic resistance to uphole movement of the activator piston 306 in the activating direction, thus urging the activator piston 306 in the opposite, deactivating direction. The deactivator piston 309 has a similar, oppositely acting deactivator spring 339.

The pistons 306, 309 are configured and located in the housing 217 such that they are exposed to a similar extent to the common poor-annulus pressure differential, while the activator spring 342 and the deactivator spring 339 are similarly graded. In particular, the pistons springs 339, 342 are selected such that they respectively overcome hydraulic forces respectively acting on the pistons 306, 309 while the bore annulus pressure differential is below the above-mentioned threshold value, while the hydraulic forces exceed the respective resilient resistance of the piston springs 339, 342 for above-threshold downhole drilling fluid pressure conditions. As a result, the pistons 306, 309 are configured for synchronous axial movement towards each other (against the urging of the piston springs 339, 342) when the pressure differential exceeds the threshold, and are configured for synchronous axial movement away from each other under the urging of their respective piston springs 339, 342 when the pressure differential is below the operational threshold.

The controller 148 further comprises a coupling mechanism to couple either the activator piston 306 or the deactivator piston 309 at any particular time to the switch sleeve 303 for longitudinal displacement therewith, thus permitting selection of which one of the pair of pistons 306, 309 will shunt the switch sleeve 303 when the above-threshold drilling fluid conditions are present at the the controller 148. The coupling mechanism is thus, in this example embodiment, switchable between (a) an activation mode (in which the deactivator piston 309 is configured for decoupled movement relative to the switch sleeve 303 in the deactivating direction, while the activator piston 306 is configured for coupled movement with the switch sleeve 303 in the activating direction) and, (b) a deactivation mode (in which the activator piston 306 is configured for decoupled movement relative to the switch sleeve 303 in the activating direction, while the deactivator piston 309 is configured for coupled movement with the switch sleeve 303 in the deactivating direction).

The coupling mechanism may comprise a pair of catch devices for the pair of hydraulic rams. The catch devices in this example embodiment comprises an activator lug 318 and a deactivator lug 321 provided on the activator piston 306 and on the deactivator piston 309 respectively, to key the switch sleeve 303 longitudinally to a particular one of the pistons 306, 309 depending on an operational state of the respective catch device. As will be described below, each of the lugs 318, 321 is disposable between (a) an operative state in which it is configured for coupling the corresponding piston to the switch sleeve 303, and (b) an inoperative state in which it is configured for decoupled movement relative to the switch sleeve 303. The coupling mechanism may include a selector 312 to selectively switch a particular one of the lugs 318, 321 to the operative state, while switching the other one of the lugs 318, 321 to the inoperative state, thereby disposing the coupling mechanism to the activation mode or to the deactivation mode, as the case may be.

As shown in FIG. 4B, the tubular bodies 505 the pistons 306, 309 have similar radial dimensions, in particular having an outer diameter which is smaller than an inner diameter of the switch sleeve 303 with which is co-axially aligned, thereby allowing axial sliding of the respective tubular bodies 505 within the switch sleeve 303. Each of the lugs 318, 321, however, projects radially outwards from the tubular bodies 505 of the pistons 306, 309, radially overlapping at least part of the switch sleeve 303 to catch on an axial end edge of the switch sleeve 303 during converging axial movement of the pistons 306, 309 and thereby to couple the associated one of the pistons 306, 309 to the switch sleeve 303. To permit longitudinal coupling of only one of the lugs 318, 321 to the switch sleeve 303, however, the lugs 318, 321 are deflectable radially inwards when they are in the inoperative state, but are buttressed or reinforced against radially inward deflection when they are in the operative state.

The selector 312 in this example embodiment includes a selector shank 324 serving as a hollow mandrel that is co-axially slidable within cylindrical passages provided by the tubular bodies 505 of the pistons 306, 309. An outer diameter of the selector shank 324 is therefore only somewhat smaller than an inner diameter of the pistons' tubular bodies 505, being a sliding fit therein. A radially outer cylindrical surface of the selector shank 324 therefore provides a reinforcement structure or buttressing surface radially below the lugs 318, 321, to resist radial deflection of the lugs 318, 321 and permit coupling of the lugs 318, 321 to the switch sleeve 303. The selector shank 324 has a hollow interior that provides a mud passage 345 (see FIG. 4B) which is in fluid flow connection with and forms part of the bore 128 the drill string 108, when in the housing 217 is incorporated in-line in the drill string 108.

In this example, the catch devices provided by the respective lugs 318, 321 are angularly misaligned, with the selector 312 including a catch selection formation which has a limited circumferential extent, the selector 312 being configured for indexed rotation to bring a catch selection formation into the circumferential alignment with one of the lugs 318, 321. The catch selection formation of the example selector 312 comprises a pair of recesses in the radially outer surface of the selector shank 324, in this example comprising an activator pocket 408 and a deactivator pocket 404 which are in circumferential alignment and are longitudinally spaced apart.

When brought into register with the activator lug 318, the activator pocket 408 effectively removes the reinforcement of buttressing provided by the selector shank 324 to the activator lug 318, allowing radially inward deflection of the activator lug 318 into a subjacent void provided by the activator pocket 408. Thus, when the activator pocket 408 is in register with the activator lug 318, the activator lug 318 is in the inoperative state and is configured for subduction under the switch sleeve 303 in response to axial sliding of the activator piston 306 into longitudinal overlap with the switch sleeve 303. Similar considerations apply to the deactivator pocket 404 when it is in circumferential and axial register with the deactivator lug 321.

Figure 5A:
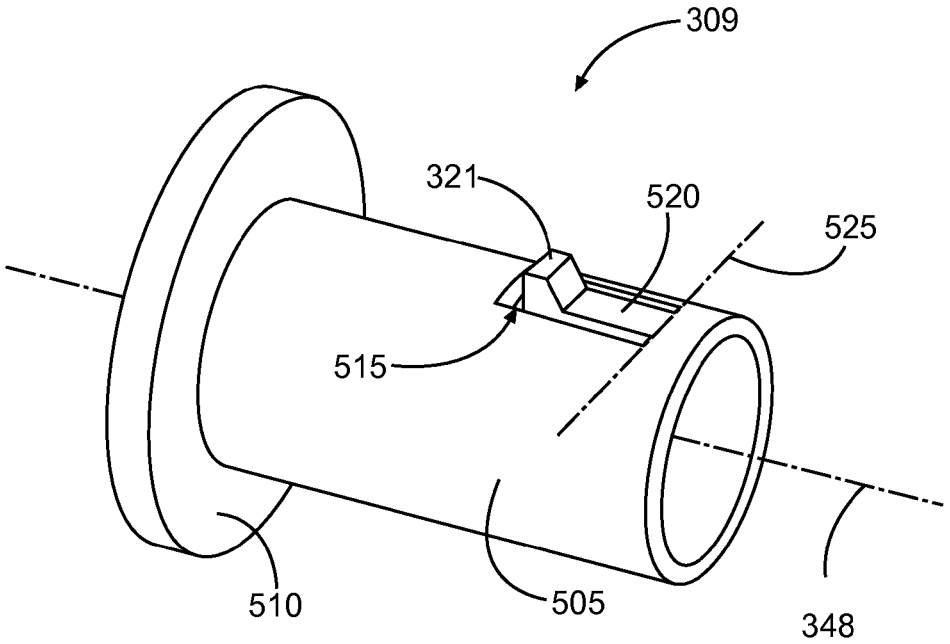
FIGS. 5A and 5B are respective three-dimensional views of a hydraulic ram to form part of the controller assembly similar analogous to the example controller assembly of FIG. 4A, the hydraulic ram being shown in a coupled condition in FIG. 5A and in a decoupled condition in FIG. 5B.
Figure 5B:
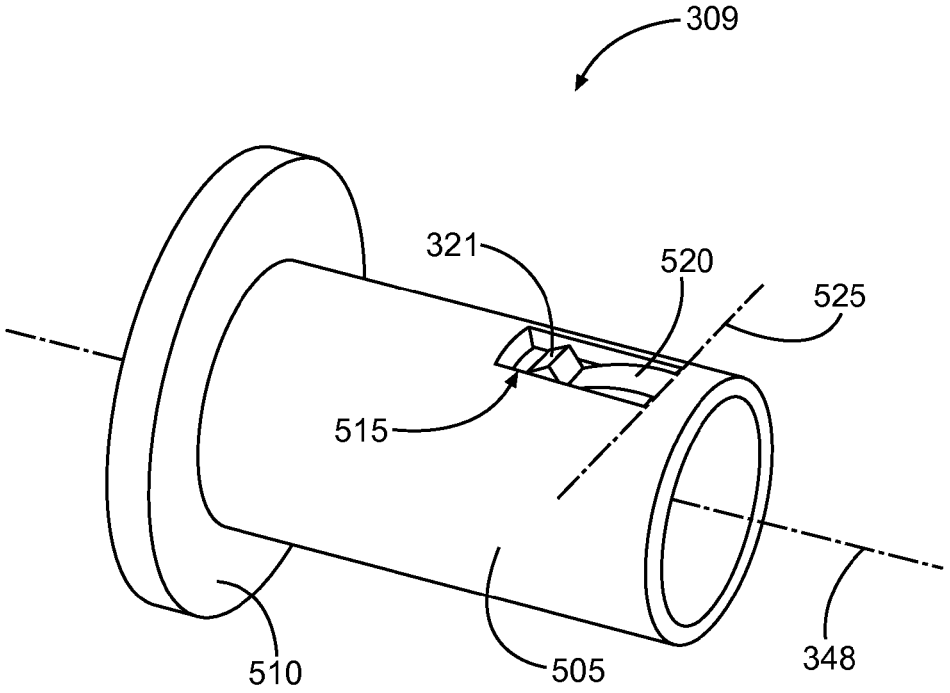

Turning briefly to FIGS. 5A and 5B, configuration and arrangement of the lugs 318, 321 are shown with reference to a three-dimensional schematic view of the deactivator piston 309 in isolation. In this example embodiment, the activator piston 306 is of identical construction to the described deactivator piston 309, but is in operation oppositely oriented, being rotated through 60° about the longitudinal axis 348. Only the deactivator lug 321 is described below in greater detail, but note that the description applies analogously to the activation lug 318.

Radial deflectability of the deactivator lug 321 is achieved in this example embodiment by location of the deactivator lug 321 at a distal end of a cantilevered limb or finger 520 located within a complementary slit 515 in the tubular body 505 of the deactivator piston 309. An upper surface of the finger 520 is flush with the cylindrical outer surface of the tubular body 505, so that only the deactivator lug 321 stands proud of the tubular body 505 when the finger 520 is unstressed (FIG. 5A).

The finger 520 extends longitudinally, being integrally connected at a proximal end thereof thereof to the tubular body 505. The tubular body 505 and the finger 520 may be a monolithic mild steel construction, the finger 520 thus being resiliently flexible about a transversely extending flex axis 525.

To facilitate subduction of the deactivator lug 321 under the switch sleeve 303, by flexible, hinge-like deformation of the finger 520 about the flex axis 525, a deflection face of the deactivator lug 321 (in this example comprising the surface of the deactivator lug 321 which is directed downhole, towards the switch sleeve 303) is inclined, having a rearward slope for engagement with a complementarily sloped bevel 354 on an end face of the switch sleeve 303 at its uphole end.

Returning now to FIG. 3, it will be noted that although the activator pocket 408 and the deactivator pocket 404 are circumferentially aligned (FIG. 4B), the activator lug 318 and the deactivator lug 321 are circumferentially misaligned (FIG. 3), in this example embodiment being staggered by 60° about the longitudinal axis 348. Accordingly, the catch selection formation provided by the pockets 404, 408 can be brought into register with only one of the lugs 318, 321 at any time. Selection of a particular coupling mode for the controller 148 therefore, in this example, comprises rotating the selector 312 to bring the pockets 404, 408 into circumferential alignment with an operator-desired one of the lugs 318, 321. The controller 148 may therefore The controller 148 may therefore include a rotational indexing mechanism to provide stepwise, indexed rotation of the selector 312. In this example, the rotational indexing mechanism comprises a rotational indexer in the example form of a commutator or revolver barrel 315 configured for cooperation with an index follower 327 provided by a head of the selector 312.

The revolver barrel 315 is co-axial with the housing 217, and is configured for reciprocating axial movement within the housing 217 under hydraulic actuation by the drilling fluid. For this reason, the revolver barrel 315 has a revolver nozzle 416 at an uphole end of a mud flow passage provided co-axially within the revolver barrel 315. The revolver nozzle 416 effectively narrows the diameter of the drill string's bore 128, thus resulting in a downhole actuation of the revolver barrel 315 by drilling fluid, in use. Such a downhole actuation of the revolver barrel 315 is resisted by a corresponding bias mechanism that urges the revolver barrel 315 uphole.

Indexed rotation of the revolver barrel 315 is achieved in this example embodiment by a cam mechanism that comprises a circumferentially extending zigzagging cam slot 330 in a radially outer surface of the revolver barrel 315. A cam follower in the form of a cam pin 333 is mounted on the housing 217, projecting radially inwards into the cam slot 330. The revolver barrel 315 thus serves as a barrel cam configured for translating reciprocal axial movement to indexed rotation. The cam slot 330 is shaped such that a single cycle of reciprocal axial movement by the revolver barrel 315 (comprising a downhole stroke and an opposite uphole stroke) results in rotation of the revolver barrel 315 by an index angle of 60°, corresponding to the circumferential staggering of the lugs 318, 321.

Transmission of such indexed rotation of the revolver barrel 315 to the selector 312 is achieved, in this example embodiment, by meshing of complementary axially extending, circumferentially inclined teeth 351 (see FIG. 3) on the selector 312 and the revolver barrel 315 respectively. The teeth 351 provide cooperating axially inclined surfaces to translate axial movement of the selector 312 into the barrel revolver 315 to rotation of the selector 312.

The selector 312 may be axially displaceable relative to the housing 217 and relative to the revolver barrel 315, in this example being configured for reciprocating axial movement out of and into mesh with the revolver barrel 315. As can be seen in FIG. 4B, the pockets 404, 408 are not only circumferentially out of alignment with one of the lugs 318, 321 (in FIG. 4B being circumferentially misaligned with the activator lug 318), but is also longitudinally out of alignment with the corresponding lugs 318, 321. The respective pockets 404, 408 are brought into longitudinal alignment with the corresponding lugs 318, 321 by downhole axial movement of the selector 312 under hydraulic actuation by the drilling fluid. The selector 312 is in this example configured for hydraulic axial displacement by the provision of a selector nozzle 412 in the mud passage 345 of the selector 312. The controller 148 further comprises an urging mechanism to provide an axial bias to the selector 312, urging the selector 312 uphole and into mesh with the barrel revolver 315. The bias mechanism in this example comprises a helical compression spring received co-axially on the selector shank 324, to serve as a selector spring 336.

Operation of the controller 148 will now be described with reference to an example method in which selective activation and deactivation of the reamer 144 can be achieved by operator control of drilling fluid conditions, in particular by controlling the bore-annulus pressure differential by use of the pump system 132, as indicated by the graph 700 of FIG. 7. FIGS. 6A-6H schematically illustrate movement of the respective components of the controller 148 at different stages during the sequence of pressure values or variations shown schematically in the graph 700.

Figures 6A, 6B, 6C:
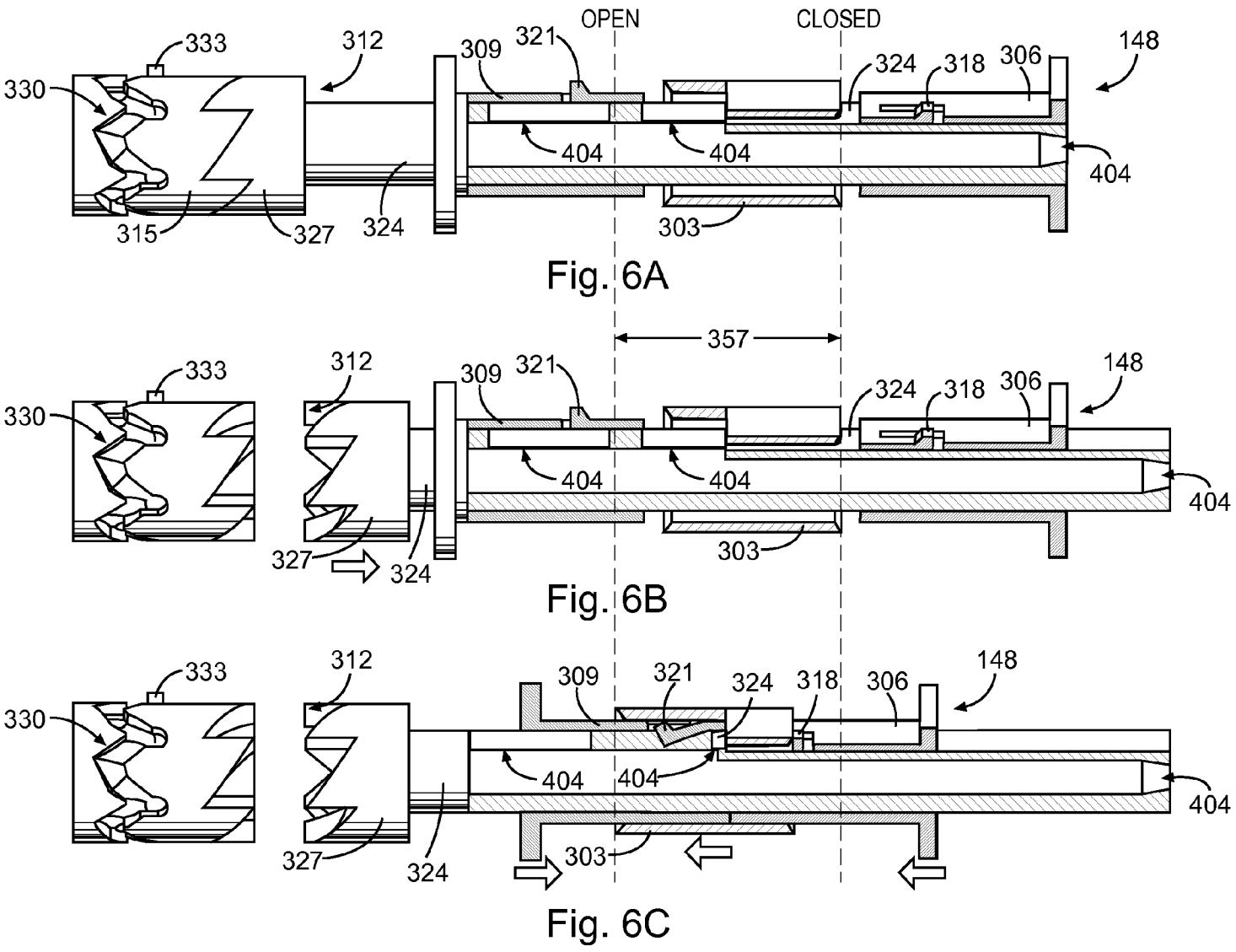
FIGS. 6A-6H are respective partially sectioned side views of a controller assembly for a downhole tool in accordance with an example embodiment, a housing of the controller assembly being omitted for illustrative clarity.

FIG. 6A shows the controller 148 in a default rest condition in which the switch sleeve 303 is located in a deactivated position corresponding to the downhole end of the switching zone 357, so that the reamer 144 connected to the switch sleeve 303 is in the deactivated condition, it is reamer arms 251 being retracted. As indicated by reference symbol A in FIG. 7, the mud flow/pressure is at this point the activated or relatively low. As a result, the deactivator piston 309 is urged to an extreme uphole position by the deactivator spring 339, the activator piston 306 is urged to an extreme downhole position by the activator spring 342, and the selector 312 is urged to its extreme uphole position by the activator spring 342, the spring in engagement with the revolver barrel 315.

The lugs 318, 321 are located outside of the switching zone 357. The deactivator lug 321 is in circumferential alignment with the deactivator pocket 404, while the activator lug 318 is circumferentially misaligned with the activator pocket 408. The coupling mechanism of the controller 148 is therefore in the activating mode, considering (as will be seen with reference to description of FIG. 6C) that converging axial movement of the pistons 306, 309 will result in shunting of the switch sleeve 303 uphole, towards the uphole end of the switching zone 357.

When a mud pump of the pump system 132 is switched on, mud pressure and flow gradually increases (FIG. 7, point B), and the selector 312 moves axially downhole under hydraulic actuation against the selector spring 336 (see FIG. 6B). Note that the selector 312 moves responsive to hydraulic actuation before the pistons 306, 309 start their actuated movement, the respective springs of the pistons 306, 309 for this reason being selected to be stronger than the selector spring 336. The downhole movement of the selector 312 brings the pockets 404, 408 into longitudinal alignment with their respective lugs 318, 321. Because the deactivator pocket 404 is already in circumferential alignment with the deactivator lug 321, the deactivator pocket 404 is brought into register with the deactivator lug 321 by the longitudinal movement of the selector 312 (FIG. 6B).

When the mud flow and pressure is further increased downhole drilling fluid conditions may (e.g., the bore-annulus pressure difference) may exceed a predetermined threshold value for actuated movement of the pistons 306, 309. At point C in FIG. 7, the controller 148 is exposed to above-threshold drilling fluid conditions. The deactivator piston 309 therefore moves under hydraulic actuation in the downhole direction, with a portion of the deactivator piston 309 being brought into longitudinal overlap with the switch sleeve 303. Because the deactivator lug 321 is in the inoperative state (being brought into register with the deactivator pocket 404), the deactivator lug 321 bends radially inwards when it engages the bevel 354 of the switch sleeve 303, allowing decoupled movement of the deactivator piston 309 relative to the switch sleeve 303. The deactivator lug 321 and its associated flexed finger 520 slides beneath the switch sleeve 303, as can be seen in FIG. 6C.

In contrast, the activator lug 318 of the activator piston 306 is in the operative state, being circumferentially misaligned with the activator pocket 408. When the activator lug 318 engages the switch sleeve 303 during actuated uphole displacement of the activator piston 306 synchronously with downhole displacement of the deactivator piston 309, deflection of the activator lug 318 is prevented by presence of the selector shank 324 beneath it. The activator lug 318 therefore catches on the switch sleeve 303, hitching or coupling it to the activator piston 306 for keyed longitudinal movement. As shown in FIG. 6C, the activator piston 306 pushes the switch sleeve 303 to the uphole end of the switching zone 357, thereby switching the reamer 144 from the deactivated condition to the activated condition, deploying the reamer arms 251.

As indicated in graph 700, the above-threshold mud pressure levels that are applied in order to activate the reamer 144 in this example embodiment corresponds to the pressure levels at which reaming is performed, so that mud pressure may be maintained at a constant level to deploy the reamer 144 and to continue reaming.

Note that the switch sleeve 303 is not configured in this example embodiment automatically to return to the deactivated position upon a a subsequent drop in mud flow/pressure. Instead, if the mud pump were, for example, to be switched off when the controller 148 is in the condition shown in FIG. 6C, the switch sleeve 303 would remain in the activated position at the uphole end of the switching zone 357, and the reamer arms 251 would remain deployed. Subsequent ramping up of mud pressure/flow levels would thus result in the application of torque and rotation to the reamer arms 251, without requiring repeat performance of the reamer deployment sequence.

If, however, the operator wishes to deactivate the reamer 144, once it has been deployed, the coupling mechanism of the controller 148 must first be switched to the deactivated condition, which in this example embodiment is achieved by application of mode switching drilling fluid pressure conditions that exposes the controller 148 to a bore-annulus pressure differential greater than the pressure differential that is applied during reaming or reamer deployment. As indicated schematically in graph 700 by the pressure curve at point D (FIG. 7), mud flow/pressure may be ramped up to a mode switching level, at which the revolver barrel 315 is hydraulically actuated downhole, and is rotated by operation of the cam pin 333 in the cam slot 330 (FIG. 6D).

Subsequent provision of above-threshold drilling fluid conditions, e.g., at reaming levels, automatically results in switching of the reamer 144 to the deactivated condition. As shown in FIG. 6G, an increase in mud flow sequentially causes: (a) downhole movement of the selector 312, to bring the activator pocket 408 into register with the activator lug 318 (FIG. 6G, corresponding to point G on graph 700), and (b) hydraulically actuated movement of the pistons 306, 309 towards each other (see, e.g., FIG. 6H, corresponding to point H on graph 700). The activator lug 318 is deflected radially inwards to slide under the switch sleeve 303, while the deactivator lug 321 catches on the switch sleeve 303, shunting it downhole from the open position to the closed position at the downhole end of the switching zone 357 (FIG. 6H).

When the mud pressure and flow is thereafter reduced to below threshold levels (e.g., to levels lower than that at which reaming is performed), the revolver barrel 315 moves uphole first, being in the process further rotated by the cam arrangement, so that a single cycle of reciprocating back-and-forth movement rotates the revolver barrel 315 by the index angle (in this example, 60°).

Figures 6D, 6E, 6F:
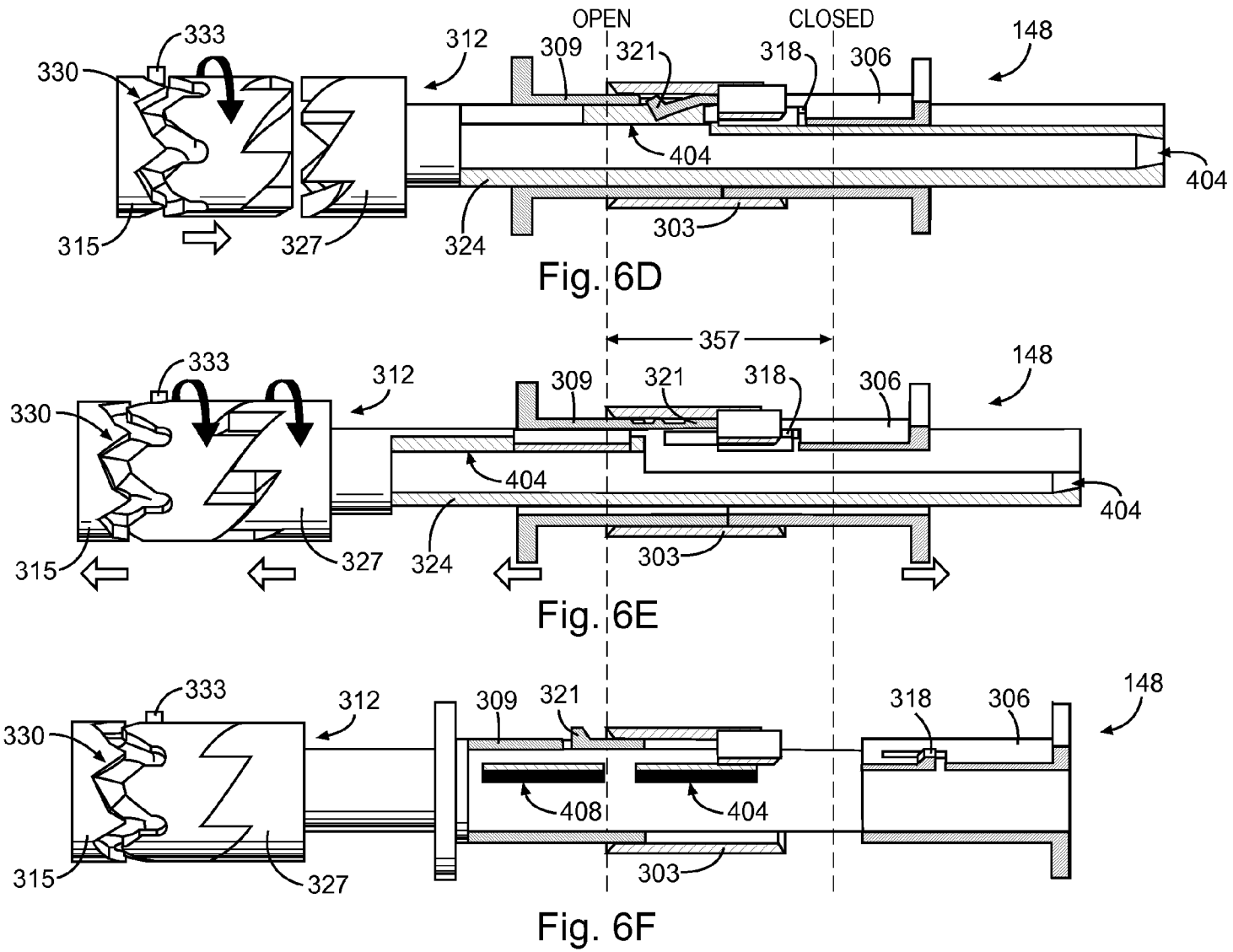
Figures 6G, 6H:
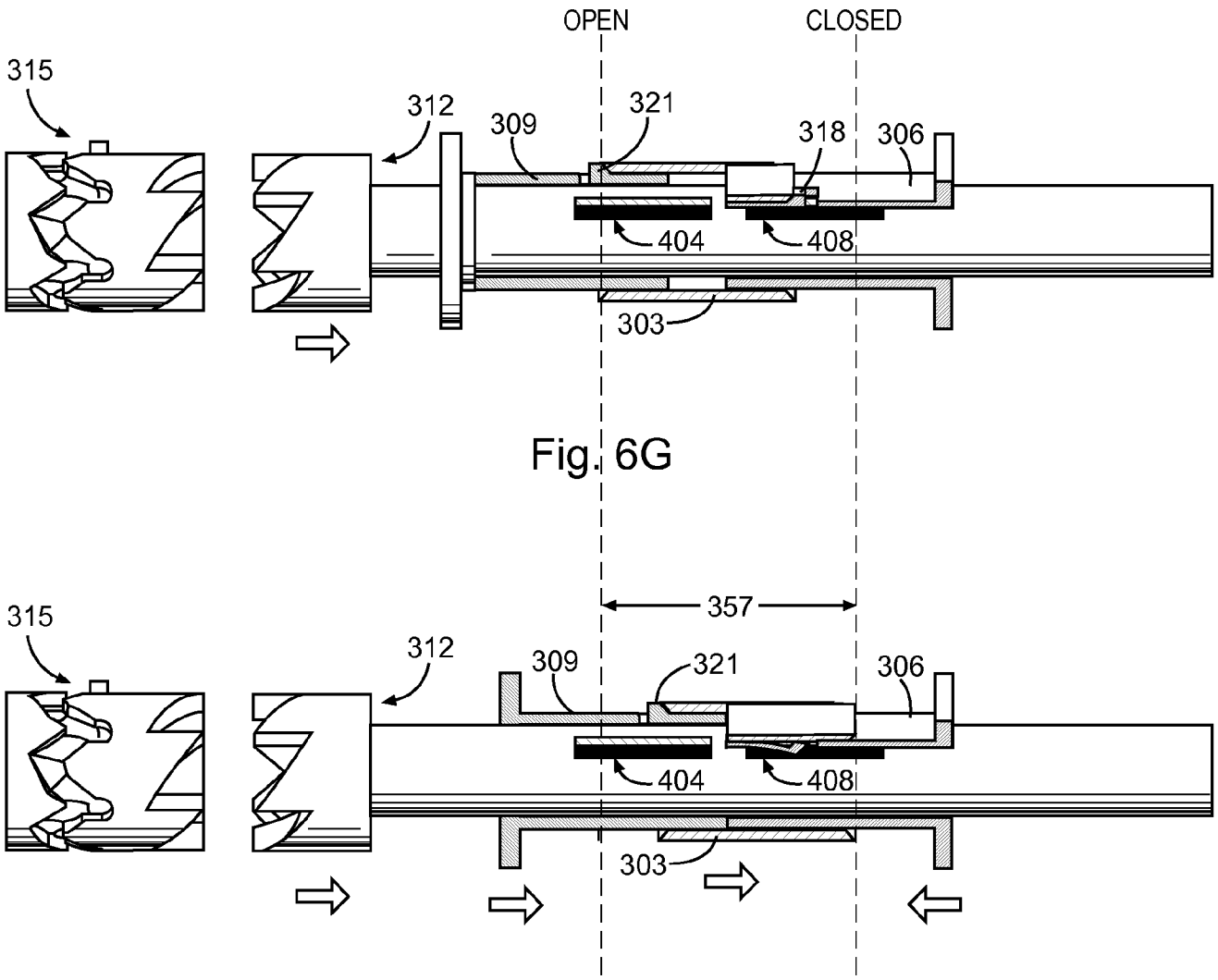

As shown in FIG. 6E, the selector 312 thereafter moves uphole under the urging of the selector spring 336, causing forced axial engagement of the teeth 351 of the index follower 327 with those of the revolver barrel 315. Because the revolver barrel 315 is keyed against rotation by the cam pin 333 while the selector 312 is substantially freely rotatable, the selector 312 rotates by operation of the inclined surfaces of the teeth 351. Such indexed rotation of the selector 312 takes the pockets 404, 408 out of circumferential alignment with the deactivator lug 321, and into the circumferential alignment with the activator lug 318 (see, for example, FIG. 6F). The controller 148 is therefore now in the deactivation mode because the deactivator lug 321 is in the operative state, being reinforced by the selector 312 against deflection radially inwards.

Note that, although the pistons 306, 309 are shown in FIG. 6E as having axial positions where the lugs 318, 321 are in the switching zone 357, the pistons 306, 309 may in operation return to their initial positions (under the urging of the relatively stronger activator spring 342 and the deactivator spring 339 respectively) before the selector 312 returns uphole into engagement with the revolver barrel 315.

Figure 7:
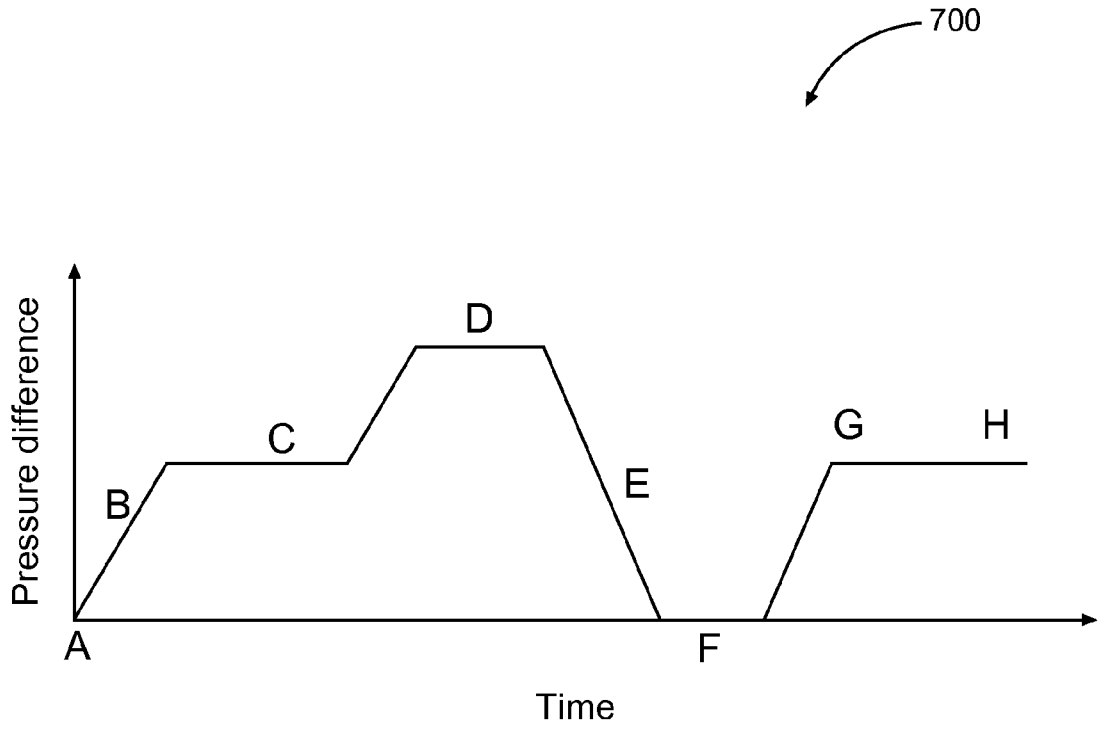
FIG. 7 is a schematic graph illustrating an example representation of operator-controlled variation of downhole drilling fluid conditions, to control a tool controller assembly similar or analogous to the example embodiment of FIGS. 6A-6H.

When the controller 148 has returned to the condition shown in FIG. 6F (for example having no drilling fluid pressure applied, as indicated by point F in FIG. 7), the components of the controller 148 are arranged identically to their initial arrangement (e.g., FIG. 6A), with the exception that the selector 312 has been rotated through 60°, so that the pockets 404, 408 are now in alignment with the activator lug 318, thereby having switched the controller 148 to the deactivating mode.

Subsequent provision of above-threshold drilling fluid conditions, e.g. at reaming levels, automatically results in switching of the reamer 144 to the deactivated condition. As shown in FIG. 6G, an increase in mud flow sequentially causes: (a) downhole movement of the selector 312, to bring the activator pocket 408 into register with the activator lug 318 (FIG. 6G, corresponding to point G on graph 707), and (b) hydraulically actuated movement of the pistons 306, 309 towards each other (see, e.g. FIG. 6H, corresponding to point H on graph 707). The activator lug 318 is deflected radially inwards to slide under the switch sleeve 303, while the deactivator lug 321 catches on the switch sleeve 303, shunting it downhole from the open position to the closed position at the downhole end of the switching zone 357 (FIG. 6H).

The selector 312 may have multiple circumferentially spaced catch selection formations (e.g., the pockets 404, 408). The pairs of pockets 404, 408 are in this example spaced at an interval equal to twice the index angle (i.e., 120 degrees). Application of switching drilling fluid conditions will thus serve to switch the controller 148 back to the activation mode by rotating the selector 312 by a further 60 degrees. Accidental deployment is avoided by requiring application of the switching mode pressure levels, which are higher than operational reaming levels.

It is a benefit of the above-described example drilling installation, drill string, controller assembly and method, that deactivation of the reamer 144 comprises hydraulically actuated movement of the switch sleeve 303, which is more reliable and quicker than relying on an urging mechanism, such as a compression spring, to cause tool deactivation. This is particularly beneficial when the controller 148 is used in combination with a reamer, considering that the reamer arms 251 are prone to provide significant resistance to radial retraction.

Further benefits are provided by the symmetry of the activation components and the deactivation components. One result of this bimodal axial symmetry is that the forces exerted on the reamer arms 251 are substantially the same. Identical construction of, for example, the activator piston 306 and the deactivator piston 309 has the benefit of reducing inventory and manufacturing costs.

Utilization exclusively of hydraulic actuation both for activating and deactivating the associated tool (e.g., the reamer 144) enables the provision of a controller mechanism that is compact relative to, for example, electronic controllers. Opposite actuation of the pistons 306, 309 to shunt a common switch member, for example, results in radial compactness of the construction.

One aspect of the disclosure that is described in the example embodiments comprises an assembly configured for use in a drill string within a borehole, wherein the drill string will include a drill string tool and will have a longitudinal internal bore to convey pressurized drilling fluid, the assembly comprising:

an elongate housing configured for in-line incorporation in the drill string;

a displaceable switch member mounted in the housing and configured to switch the drill string tool between an activated condition and a deactivated condition in response to driven longitudinal movement of the switch member in an activating direction and in an opposite deactivating direction, respectively;

a pair of hydraulic rams mounted in the housing and configured for oppositely directed movement respectively in the activating direction and in the deactivating direction in response to above-threshold drilling fluid conditions at the housing, so that the pair of hydraulic rams comprises an activator ram and a deactivator ram; and a coupling mechanism configured for operator-controlled selective switching between an activation mode in which the switch member is decoupled from the deactivator ram, and in which the activator ram is configured for coupled movement with the switch member in the activating direction, to switch the drill string tool to the activated condition by driving the switch member in the activating direction, and a deactivation mode in which the switch member is decoupled from the activator ram, and in which the deactivator ram is configured for coupled movement with the switch member in the deactivating direction, to switch the drill string tool to the deactivated condition by driving the switch member in the deactivating direction.

In the above-referenced described example embodiments, the activation direction extends longitudinally, so that movement in the activation direction comprises longitudinal movement. The switch member and the hydraulic rams are thus configured for sliding movement substantially parallel to the longitudinal axis of the drill string. In other embodiments, however, the activation direction may be a rotational direction, in which case the hydraulic rams and the switch member may be configured for rotary movement.

The pair of hydraulic rams and the switch member may be coaxially aligned, at least part of the switch member being longitudinally located between the pair of hydraulic rams, the pair of hydraulic rams being configured for co-axial movement towards each other and into at least partial longitudinal overlap with the switch member in response to the above-threshold drilling fluid conditions. The coupling mechanism may comprise a pair of respective catch devices for the pair of hydraulic rams, each catch device being operable between an inoperative state in which the catch device is configured to permit relative axial movement thereof into an overlapping portion of the switch member and the associated hydraulic ram; and an operative state in which the catch device is configured to catch relative axial movement between the switch member and the associated hydraulic ram during movement of the hydraulic rams towards each other, to couple the switch member to the associated hydraulic ram by preventing movement of the catch device into the overlapping portion of the switch member and the associated hydraulic ram.

The coupling mechanism may further comprise a selector displaceably mounted in the housing and configured for selective displacement relative to the housing to dispose one of the catch devices in the operative state and while disposing the other one of the catch devices in the inoperative state, and vice versa, to switch the coupling mechanism between the activation mode and the deactivation mode.

The selector may extend longitudinally, being co-axial with the pair of hydraulic rams, the selector further comprising a catch selection formation configured to dispose a respective catch device in one of the operative state and the inoperative state when the catch selection formation is in register with the respective catch device, the respective catch device being in the other one of the operative state and the inoperative state when the catch selection formation in out of register therewith.

Each catch device may comprise a deflectable lug projecting radially from the respective hydraulic ram and into radial overlap with the switch member, the selector being co-axially arranged with the pair of hydraulic rams and being configured to resist radial deflection of one of the lugs, while allowing radial deflection of the other one of the lugs by positioning the catch selection formation in the form of a cavity in the selector in register with said other one of the lugs. The pair of catch devices may be circumferentially misaligned with each other, the catch selection formation having a limited circumferential extent, and wherein the selector is configured for indexed rotation to bring the catch selection formation into circumferential alignment with a selected one of the catch devices.

The assembly may further comprise a rotational indexing mechanism configured to rotate the selector through an index angle in response to occurrence of predetermined mode switching drilling fluid conditions at the housing, to move the catch selection formation out of circumferential alignment with one of the catch devices and into circumferential alignment with the other catch device. The selector may be configured for hydraulically actuated movement out of engagement with the rotational indexing mechanism in response to the above-threshold drilling fluid conditions, the rotational indexing mechanism being configured for hydraulically actuated rotation through the index angle in response to the mode switching drilling fluid conditions, and wherein the selector is configured for automatic transmission of indexed rotation of the rotational indexing mechanism to the selector in response to subsequent axial displacement of the selector into engagement with the rotational indexing mechanism.

In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. An assembly configured for use in a drill string that includes a drill string tool, the drill string having an internal bore to convey drilling fluid, the assembly comprising:

an elongate housing configured for incorporation in the drill string;

a switch member displaceably mounted on the housing and configured for connection to the drill string tool to switch the drill string tool between an activated condition and a deactivated condition in response to driven movement of the switch member in an activating direction and in an opposite deactivating direction, respectively;

a pair of hydraulic rams mounted on the housing and configured for oppositely directed movement respectively in the activating direction and in the deactivating direction in response to above-threshold drilling fluid conditions at the housing, so that the pair of hydraulic rams comprises an activator ram and a deactivator ram; and a coupling mechanism configured for operator-controlled selective switching between an activation mode in which the switch member is decoupled from the deactivator ram, and in which the activator ram is configured for coupled movement with the switch member in the activating direction, to switch the drill string tool to the activated condition by driving the switch member in the activating direction, and a deactivation mode in which the switch member is decoupled from the activator ram, and in which the deactivator ram is configured for coupled movement with the switch member in the deactivating direction, to switch the drill string tool to the deactivated condition by driving the switch member in the deactivating direction.

2. The assembly of claim 1, wherein movement in the activation direction comprises longitudinal movement, and wherein the pair of hydraulic rams and the switch member are coaxially aligned, at least part of the switch member being longitudinally located between the pair of hydraulic rams, the pair of hydraulic rams being configured for co-axial movement towards each other and into at least partial longitudinal overlap with the switch member in response to the above-threshold drilling fluid conditions, the coupling mechanism comprising a pair of respective catch devices for the pair of hydraulic rams, each catch device being operable between an inoperative state in which the catch device is configured to permit relative axial movement thereof into an overlapping portion of the switch member and the associated hydraulic ram; and an operative state in which the catch device is configured to catch relative axial movement between the switch member and the associated hydraulic ram during movement of the hydraulic rams towards each other, to couple the switch member to the associated hydraulic ram by preventing movement of the catch device into the overlapping portion of the switch member and the associated hydraulic ram.

3. The assembly of claim 2, wherein the coupling mechanism further comprises a selector displaceably mounted in the housing and configured for selective displacement relative to the housing to dispose one of the catch devices in the operative state and while disposing the other one of the catch devices in the inoperative state, and vice versa, to switch the coupling mechanism between the activation mode and the deactivation mode.

4. The assembly of claim 3, wherein the selector extends longitudinally and is co-axial with the pair of hydraulic rams, the selector further comprising a catch selection formation configured to dispose a respective catch device in one of the operative state and the inoperative state when the catch selection formation is in register with the respective catch device, the respective catch device being in the other one of the operative state and the inoperative state when the catch selection formation in out of register therewith.

5. The assembly of claim 4, wherein each catch device comprising a deflectable lug projecting radially from the respective hydraulic ram and into radial overlap with the switch member, the selector being co-axially arranged with the pair of hydraulic rams and being configured to resist radial deflection of one of the lugs, while allowing radial deflection of the other one of the lugs by positioning the catch selection formation in the form of a cavity in the selector in register with said other one of the lugs.

6. The assembly of claim 4, wherein the pair of catch devices are circumferentially misaligned with each other, the catch selection formation having a limited circumferential extent, and wherein the selector is configured for indexed rotation to bring the catch selection formation into circumferential alignment with a selected one of the catch devices.

7. The assembly of claim 6, further comprising a rotational indexing mechanism configured to rotate the selector through an index angle in response to occurrence of predetermined mode switching drilling fluid conditions at the housing, to move the catch selection formation out of circumferential alignment with one of the catch devices and into circumferential alignment with the other catch device.

8. The assembly of claim 7, wherein the selector is configured for hydraulically actuated movement out of engagement with the rotational indexing mechanism in response to the above-threshold drilling fluid conditions, the rotational indexing mechanism being configured for hydraulically actuated rotation through the index angle in response to the mode switching drilling fluid conditions, and wherein the selector is configured for automatic transmission of indexed rotation of the rotational indexing mechanism to the selector in response to subsequent axial displacement of the selector into engagement with the rotational indexing mechanism.

9. The assembly of claim 8, further comprising a selector biasing mechanism configure to urge axial movement of the selector into engagement with the rotational indexing mechanism.

10. The assembly of claim 2, wherein the switch member comprises a hollow sleeve within which at least part of the respective hydraulic rams are co-axially slidable, each catch device comprising a lug projecting radially between the associated hydraulic ram and the switch member to resist, in the operative state, relative movement thereof into the overlapping portion of the switch member and the associated hydraulic ram, the lug being configured for radial retraction when it is in the inoperative state.

11. The assembly of claim 1, wherein the switch member is coupled to the drill string tool to switch the drill string tool between the activated condition and the deactivated condition by driven axial displacement of the switch member.

12. A drilling installation comprising:

an elongated drill string extending longitudinally along a borehole, the drill string having a housing that defines a longitudinally extending bore configured to convey drilling fluid under pressure;

a drill string tool forming part of the drill string and configured to be disposable between an activated condition and a deactivated condition;

a control mechanism coupled to the drill string tool and configured to allow operator-controlled switching of the drill string tool by control of drilling fluid pressure conditions, the control mechanism comprising:

a switch member displaceably mounted on the housing and configured to switch the drill string tool between the activated condition and the deactivated condition in response to driven longitudinal movement of the switch member in an activating direction and in an opposite deactivating direction, respectively;

a pair of hydraulic rams mounted on the housing and configured for oppositely directed movement respectively in the activating direction and in the deactivating direction in response to above-threshold drilling fluid conditions at the housing, so that the pair of hydraulic rams comprises an activator ram and a deactivator ram; and a coupling mechanism configured for operator-controlled selective switching between an activation mode in which the switch member is decoupled from the deactivator ram, and in which the activator ram is configured for coupled movement with the switch member in the activating direction, to switch the drill string tool to the activated condition by driving the switch member in the activating direction, and a deactivation mode in which the switch member is decoupled from the activator ram, and in which the deactivator ram is configured for coupled movement with the switch member in the deactivating direction, to switch the drill string tool to the deactivated condition by driving the switch member in the deactivating direction.

13. The drilling installation of claim 12, wherein movement in the activation direction comprises longitudinal movement, and where in wherein the pair of hydraulic rams and the switch member are coaxially aligned, at least part of the switch member being longitudinally located between the pair of hydraulic rams, the pair of hydraulic rams being configured for co-axial movement towards each other and into at least partial longitudinal overlap with the switch member in response to the above-threshold drilling fluid conditions, the coupling mechanism comprising a pair of respective catch devices for the pair of hydraulic rams, each catch device being operable between an inoperative state in which the catch device is configured to permit relative axial movement thereof into an overlapping portion of the switch member and the associated hydraulic ram; and an operative state in which the catch device is configured to catch relative axial movement between the switch member and the associated hydraulic ram during movement of the hydraulic rams towards each other, to couple the switch member to the associated hydraulic ram by preventing movement of the catch device into the overlapping portion of the switch member and the associated hydraulic ram.

14. The drill installation of claim 13, wherein the coupling mechanism further comprises a selector displaceably mounted in the housing and configured for selective displacement relative to the housing to dispose one of the catch devices in the operative state and while disposing the other one of the catch devices in the inoperative state, and vice versa, to switch the coupling mechanism between the activation mode and the deactivation mode.

15. The drilling installation of claim 14, wherein the selector extends longitudinally and is co-axial with the pair of hydraulic rams, the selector further comprising a catch selection formation configured to dispose a respective catch device in one of the operative state and the inoperative state when the catch selection formation is in register with the respective catch device, the respective catch device being in the other one of the operative state and the inoperative state when the catch selection formation in out of register therewith.

16. The drilling installation of claim 15, wherein each catch device comprising a deflectable lug projecting radially from the respective hydraulic ram and into radial overlap with the switch member, the selector being co-axially arranged with the pair of hydraulic rams and being configured to resist radial deflection of one of the lugs, while allowing radial deflection of the other one of the lugs by positioning the catch selection formation in the form of a cavity in the selector in register with said other one of the lugs.

17. The drilling installation of claim 15, wherein the pair of catch devices are circumferentially misaligned with each other, the catch selection formation having a limited circumferential extent, and wherein the selector is configured for indexed rotation to bring the catch selection formation into circumferential alignment with a selected one of the catch devices.

18. The drilling installation of claim 17, further comprising a rotational indexing mechanism configured to rotate the selector through an index angle in response to occurrence of predetermined mode switching drilling fluid conditions at the housing, to move the catch selection formation out of circumferential alignment with one of the catch devices and into circumferential alignment with the other catch device.

19. The drilling installation of claim 18, wherein the selector is configured for hydraulically actuated movement out of engagement with the rotational indexing mechanism in response to the above-threshold drilling fluid conditions, the rotational indexing mechanism being configured for hydraulically actuated rotation through the index angle in response to the mode switching drilling fluid conditions, and wherein the selector is configured for automatic transmission of indexed rotation of the rotational indexing mechanism to the selector in response to subsequent axial displacement of the selector into engagement with the rotational indexing mechanism.

20. The drilling installation of claim 13, wherein the switch member comprises a hollow sleeve within which at least part of the respective hydraulic rams are co-axially slidable, each catch device comprising a lug projecting radially between the associated hydraulic ram and the switch member to resist, in the operative state, relative movement thereof into the overlapping portion of the switch member and the associated hydraulic ram, the lug being configured for radial retraction when it is in the inoperative state.

21. A method of controlling a drill string tool coupled in a drill string within a borehole, the drill string defining an internal bore to convey drilling fluid under pressure, the method comprising:

incorporating in the drill string a control mechanism for the drill string tool, the control mechanism comprising:

a displaceable switch member mounted in a housing and coupled to the drill string tool;

a pair of hydraulic rams mounted in the housing and configured for oppositely directed movement respectively in an activating direction and in a deactivating direction in response to above-threshold drilling fluid conditions at the housing, so that the pair of hydraulic rams comprises an activator ram and a deactivator ram; and a coupling mechanism disposed in a an activation mode in which a switch member is decoupled from the deactivator ram, and in which the activator ram is configured for coupled movement with the switch member in the activating direction, to switch the drill string tool to the activated condition by driving the switch member in the activating direction; and controlling drilling fluid conditions at the control mechanism to cause predefined mode switching drilling fluid conditions at the control mechanism, thereby switching the coupling mechanism from the activation to a deactivation mode in which the switch member is decoupled from the activator ram, and in which the deactivator ram is configured for coupled movement with the switch member in the deactivating direction, to switch the drill string tool to the deactivated condition by driving the switch member in the deactivating direction.

* * * * *